US006162098A

United States Patent [19]

Cheng et al.

[11] Patent Number: 6,162,098

[45] Date of Patent: Dec. 19, 2000

[54] MODIFIED CONNECTOR FOR CAR BATTERY

[76] Inventors: Wen Tzung Cheng; Wen Ho Cheng, both of No. 78, Chao Chou St., Tao Yuan, Taiwan

[21] Appl. No.: 09/496,045

[22] Filed: Feb. 2, 2000

[51] Int. Cl.[7] ..... H01R 13/68; H01R 33/95

[52] U.S. Cl. ..... 439/621; 439/763

[58] Field of Search ..... 439/726, 754, 439/755, 756, 774, 202, 366, 763, 764, 621, 957

[56] References Cited

U.S. PATENT DOCUMENTS

| | | | |
|---|---|---|---|
| 3,795,891 | 3/1974 | Bailey | 439/388 |
| 5,171,169 | 12/1992 | Butcher et al. | 439/755 |
| 5,648,749 | 7/1997 | Lin et al. | 337/205 |
| 5,888,098 | 3/1999 | Cheng et al. | 439/621 |

*Primary Examiner*—Khiem Nguyen
*Assistant Examiner*—Hae Moon Hyeon
*Attorney, Agent, or Firm*—Rosenberg, Klein & Lee

[57] ABSTRACT

The present invention proposes a modified connector for a car battery, which comprises a main body and a safety device assembled together. The main body is a conductor having a C-shaped gripper to be gripped on an electrode of the battery. At least a connection hole having inner threads is installed on the main body. The safety device comprises an insulating lagging, two connection terminals installed at two ends of the lagging, and a safety component assembled between the two connection terminals. The safety device uses one of the two connection terminals and one end of the lagging to screw in the corresponding connection hole of the main body such that all safety devices required for all electric wires along with the main body can be concentrated and fixed on the battery. Thereby the safety components in the safety devices can be checked and replaced very conveniently.

9 Claims, 9 Drawing Sheets

MODIFIED CONNECTOR FOR CAR BATTERY

FIELD OF THE INVENTION

The present invention relates to a modified connector for a car battery and, more particularly, to a modified connector which can be gripped on an electrode of a general car battery such that a plurality of wires can be separately connected thereon and at least a safety device can be linked with each wire to facilitate safety and convenience.

BACKGROUND OF THE INVENTION

Many electronic apparatuses, such as motors, lights, audio systems, or air conditioners, are installed on a general car, which has only a very limited number of batteries for supplying electric power. Therefore, how to integrate and distribute electric wires of various electronic apparatuses is very important. More importantly, for a new car having advanced electronic instruments such as the anti-braking system (ABS), the global positioning system (GPS), or other high-level audio-visual systems, there will be much more electric wires to be allocated. These electric wires are gripped on the same electrode of a battery via a gripping ring on the end thereof in prior art. Therefore, it will be very inconvenient for assembly and disassembly of each electric wire on the electrode. Also, because these electric wires adjoins and overlaps with one another, the safety problem should be very carefully take care of. As a result, many specific connectors for a battery have been developed to solve the above mentioned problems.

These connectors are mainly integrally formed metallic conductors. A C-shaped gripper controlled by a tightening screw is installed in most of these connectors to grip on an electrode of a battery. The position other than the C-shaped gripper of the connector can be expanded to form a block of arbitrary shape. A plurality of spaced connection holes are disposed at proper positions. A tightening screw is installed perpendicularly to a corresponding connection hole on the main body such that the core line of each electric wire can be inserted in the connection hole and fixedly assembled by screwing the tightening screw. Each electric wire can thus be separately and indirectly connected to the same electrode.

To make sure that better safety can be obtained, a safety device (such as a safety fuse) can be further joined with each electric wire. When loading current is too large due to some specific factor, electric power will be automatically cut off through the breaking or the switching off of the safety device. However, the locations of general safety devices vary Some are disposed at the middle section of the electric wire, while others are near the electronic apparatus. Some safety devices may be mixed with complex components of the car or near high-temperature equipment or electric systems such that it is very difficult to check or replace them.

SUMMARY AND OBJECTS OF THE PRESENT INVENTION

The primary object of the present invention is to provide a modified connected for a car battery such that safety devices can be linked with an electric wire on a main body of the connector. An insulation lagging, two conducting connection terminals, and a safety device are fixedly screwed in a connection hole preset on the main body of the connector to be joined there. Thereby safety devices can be concentrated on the main body of the connector near the battery such that they can be checked or replaced very conveniently.

The various objects and advantages of the present invention will be more readily understood from the following detailed description when read in conjunction with the appended drawings, in which:

DETAILED DESCRIPTION OF PREFERRED EMBODIMENT

Figure 1:
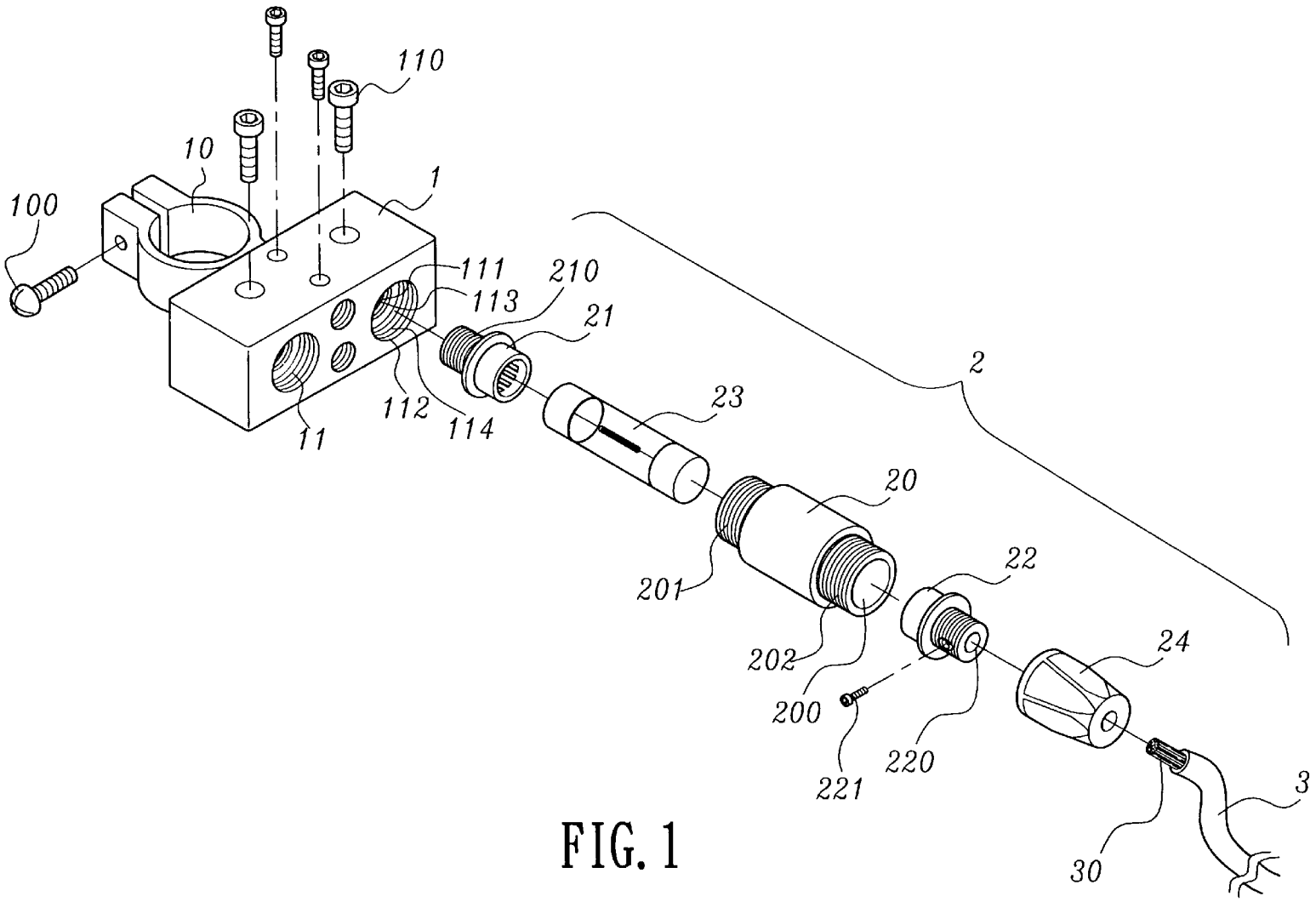
FIG. 1 is an exploded perspective view according to an embodiment of the present invention.
Figure 2:
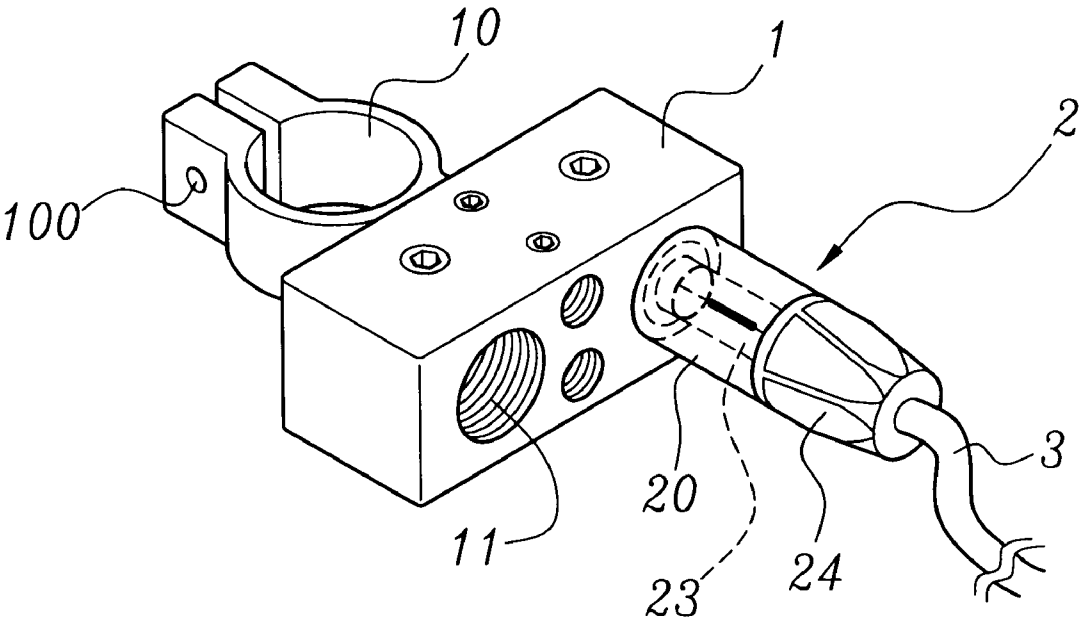
FIG. 2 is a perspective view according to an embodiment of the present invention.

FIGS. 1 and 2 show a modified connector for a car battery according to an embodiment of the present invention which comprises a main body 1 and a safety device 2 assembled together.

The main body 1 is a conductor having a C-shaped gripper 10 controlled by a screw 100. The C-shaped gripper can be fixedly gripped on an electrode of a battery (not shown). A plurality of connection holes 11 of different diameters can be disposed at proper positions other than the C-shaped gripper on the main body 1. A tightening screw 110 penetrating to a corresponding connection hole 11 can be installed perpendicularly to it such that the core line 30 of an electric wire 3 can be inserted in the connection hole 11 and fixedly assembled by screwing the tightening screw 110 to achieve electric connection. The inner side and outer side of at least a connection hole 11 respectively form an inner hole 111 of smaller diameter and an outer hole 112 of larger diameter. The inner hole can have a first inner thread 113 and the outer hole 112 can have a second inner thread 114.

Figure 3:
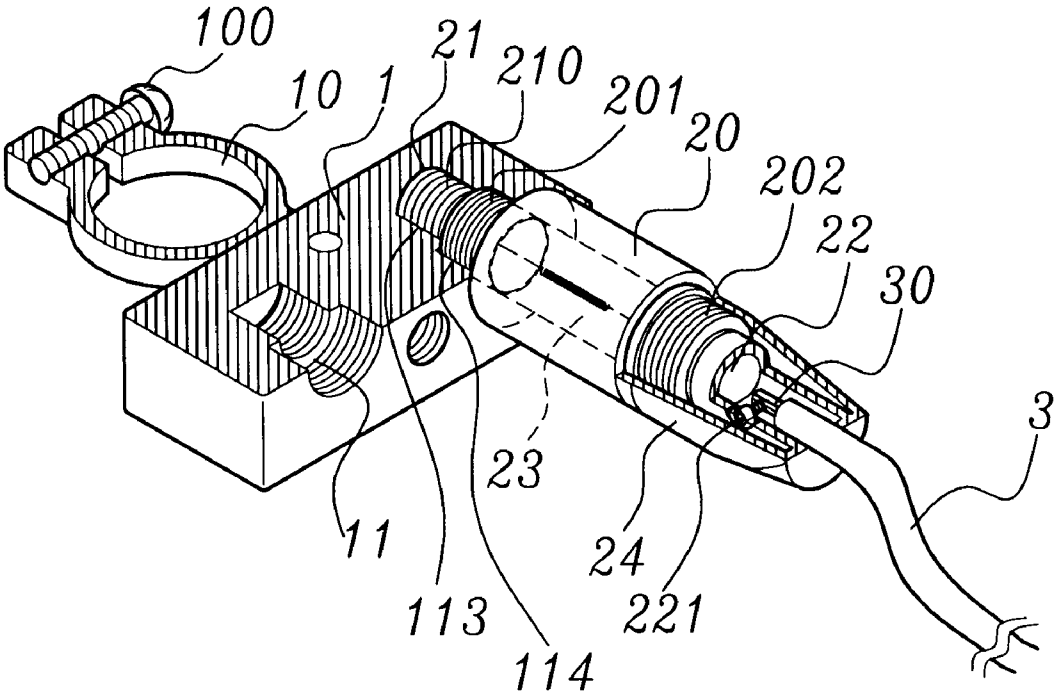
FIG. 3 is a cross-sectional perspective view according to an embodiment of the present invention.
Figure 4:
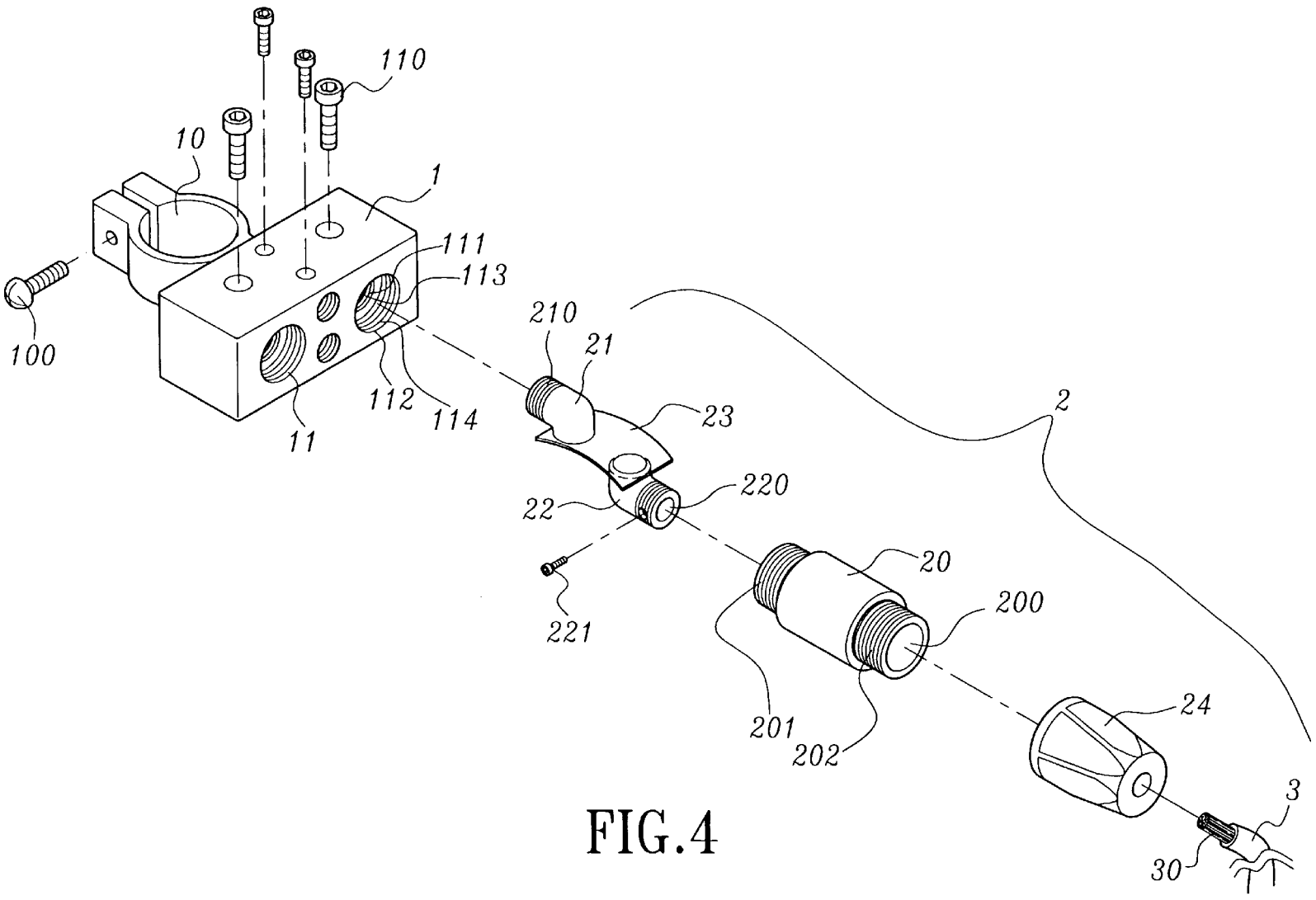
FIG. 4 is an exploded perspective view according to another embodiment of the present invention.
Figure 5:
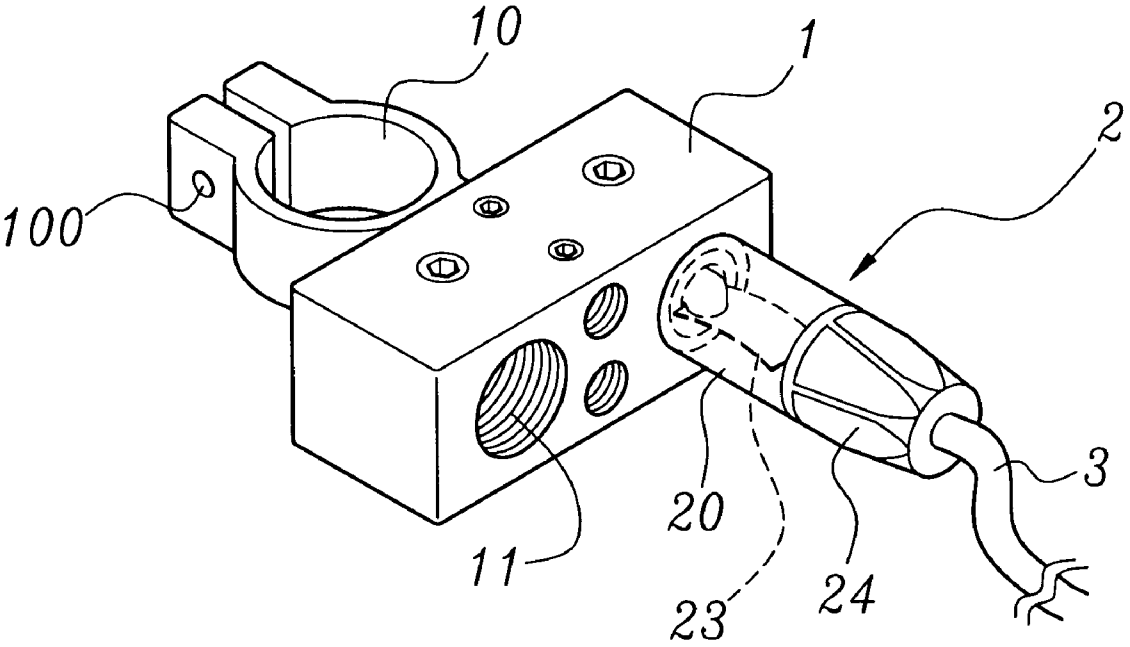
FIG. 5 is a perspective view according to another embodiment of the present invention.
Figure 6:
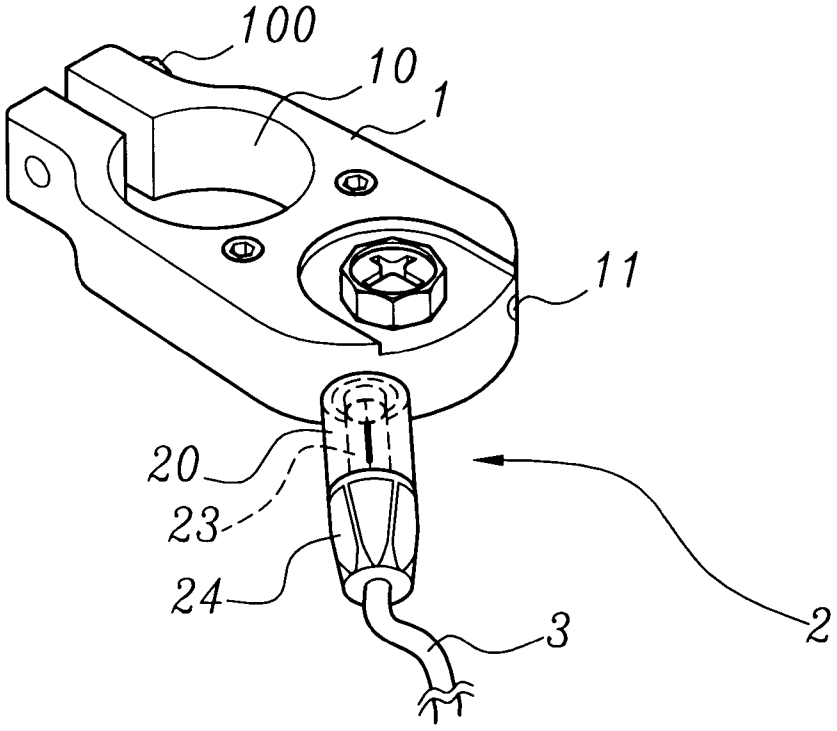
FIG. 6 is a perspective view of the present invention when applied to the main body of another connector of different shape.
Figure 7:
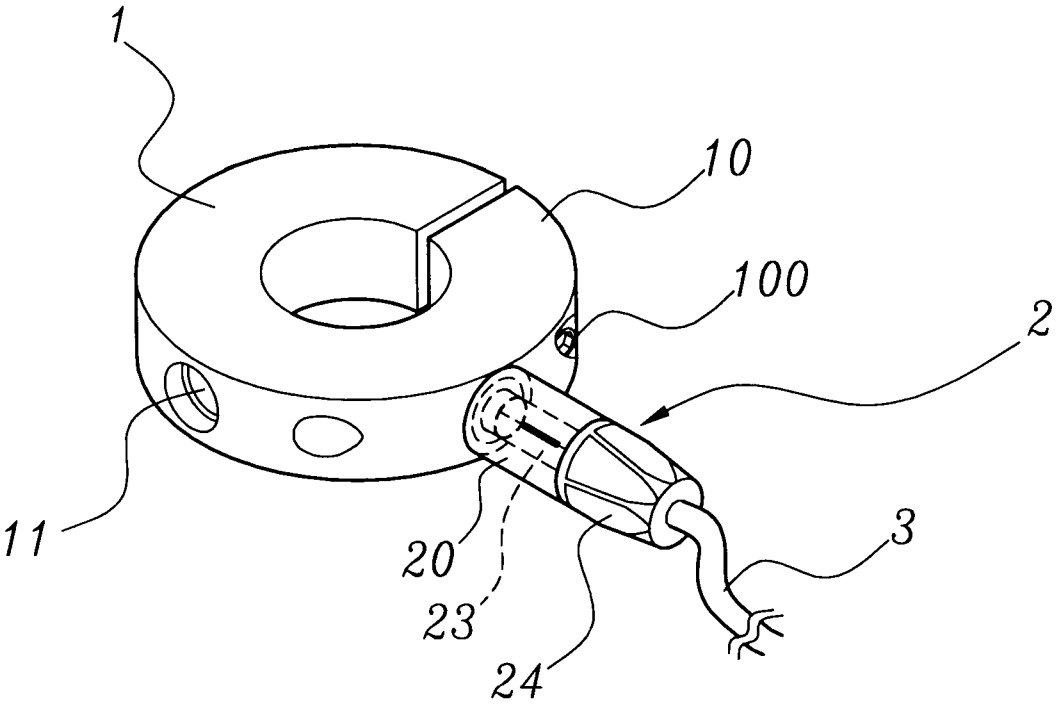
FIG. 7 is a perspective view of the present invention when applied to the main body of yet another connector of different shape.

The safety device 2 has a transparent insulation lagging 20. A first conductive connection terminal 21 and a second conductive connection terminal 22 are respectively jammed into two end openings 200 of the lagging 20 with a safety component 23 assembled between them. The safety component 23 can be a safety fuse shown in FIGS. 1 and 2 breaking automatically to cut off electric power when loading current is too large, or a circuit breaker shown in FIGS. 3 and 4 switching off automatically when loading current is too large. A first outer thread 210 is installed on the outer circumference of the first connection terminal 21. A second outer thread 201 and a third outer thread 202 are respectively installed on the outer circumferences of the two openings 200 of the lagging 20. The safety device 2 can first be screwed in the inner hole 111 via the first connection terminal 21 and the safety component 23 is then fixed. Next, the lagging 20 having the second connection terminal 22 installed thereon is screwed in the outer hole 112. Thereby the safety 2 can be assembled on the main body 1.

Figure 8:
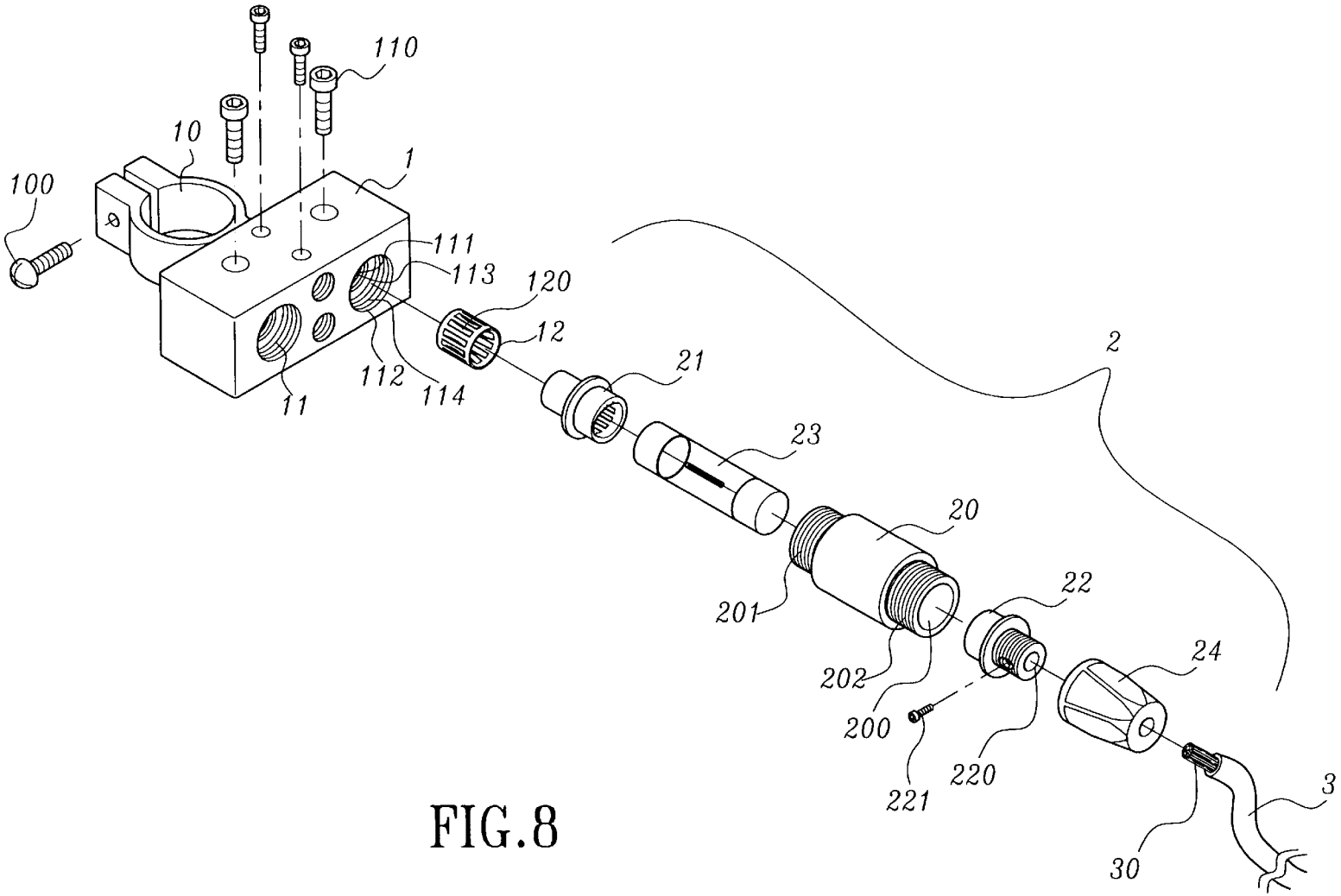
FIG. 8 is an exploded perspective view when the inner hole of the main body of the connector shown in FIG. 1 is replaced with a binding ring.
Figure 9:
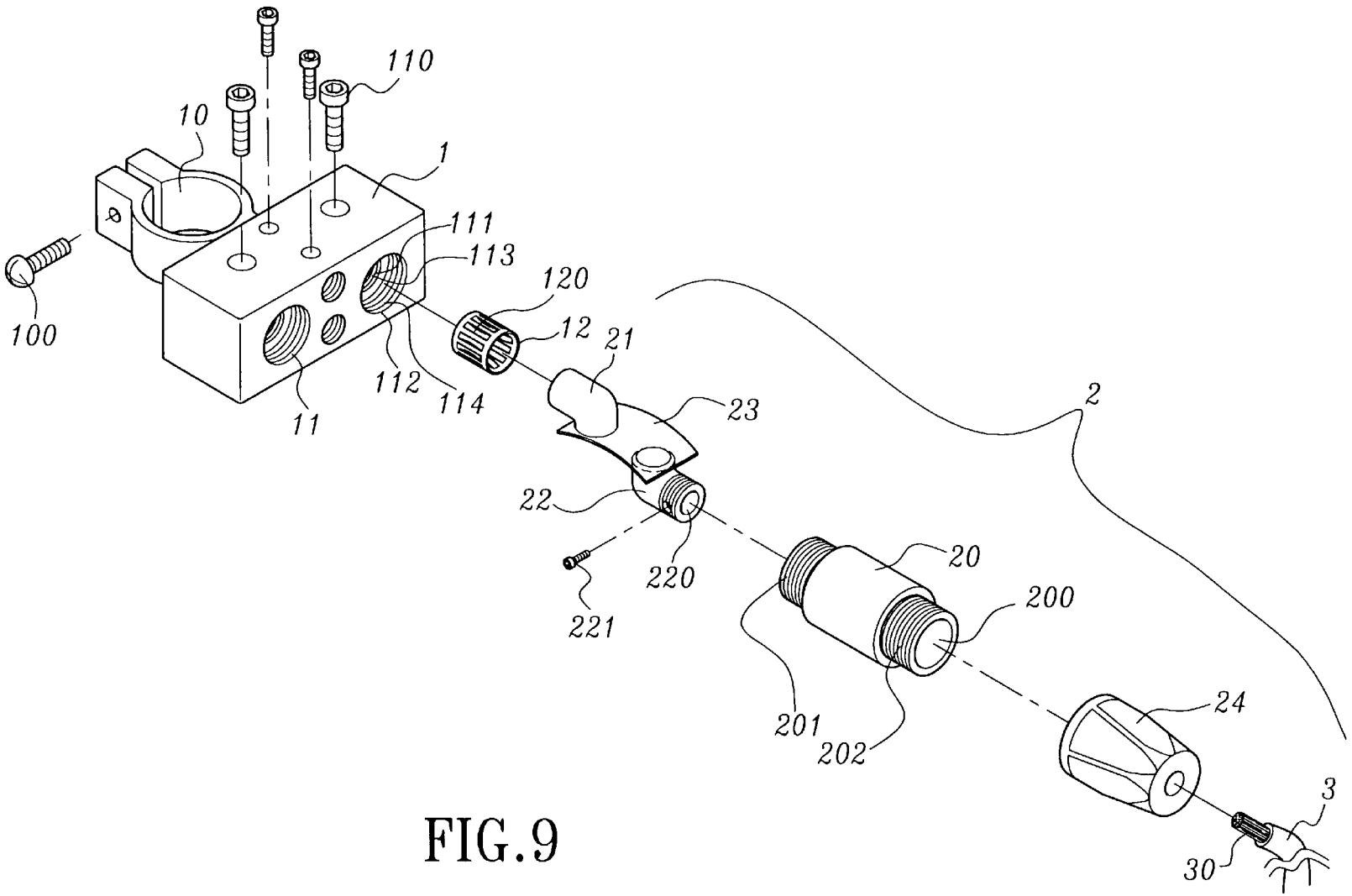
FIG. 9 is an exploded perspective view when the inner hole of the main body of the connector shown in FIG. 4 is replaced with a binding ring.

As shown in FIGS. 8 and 9, instead of using the thread, a binding ring 12 can be jammed into the inner hole 111 of the main body 1. The binding ring 12 has a plurality of incurved resilient plates 120, which extend axially and are annularly arranged. The first connection terminal 21 can have no thread installed thereon and can be inserted directly into the inner hole 111 and gripped tightly by the binding ring 12.

The outer end of the second connection terminal 22 has a connection hole 220. A tightening screw 221 penetrating to the connection hole 220 is installed perpendicularly to it. The core line 30 of the electric wire 3 can be inserted into the connection hole 220 and stuck tightly by the tightening screw 221. An insulation end cap 24 having an inner thread is fixedly locked on the third thread 202 of the lagging 20 to complete assembly.

Instead of linking with the electric wire 3 at an arbitrary position thereof in prior art, the safety device 2 is fixedly locked on the main body 1 in the present invention. Because the main body 1 is installed on a car battery, which assembles all electric wires 3 and can be accessed easily. Thereby safety devices 2 can be concentrated and fixed on the car battery such that the safety components 23 can be checked and replaced very conveniently.

Although the present invention has been described with reference to the preferred embodiments thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A modified connector for a car battery comprising:

a main body being a conductor and having a gripping part, such that it can be gripped on an electrode of the battery, at least a connection hole being disposed on said main body, an inner hole of smaller diameter and an outer hole of larger diameter being formed in said connection hole, and at least a safety device having an insulation lagging, a first connection terminal and a second connection terminal being respectively installed at two ends of said lagging, a safety component cutting off electric power when loading current is too large being assembled between said two connection terminals, said first connection terminal being assembled in said inner hole, one end of said lagging being assembled in said outer hole, the core line of an electric wire being assembled in said second connection terminal.

2. The modified connector for a car battery of claim 1, wherein said inner hole has a first inner thread and said first connection terminal of said safety device has a corresponding first outer thread to be screwed in said inner hole.

3. The modified connector for a car battery of claim 1, wherein a binding ring is installed in said inner hole and has a plurality of incurved resilient plates, which extend axially and are annularly arranged.

4. The modified connector for a car battery of claim 2, wherein said outer hole has a second inner thread and one end of said safety device has a corresponding second outer thread to be screwed in said outer hole.

5. The modified connector for a car battery of claim 1, wherein said safety component of said safety device can be a safety fuse.

6. The modified connector for a car battery of claim 1, wherein said safety component of said safety device can be a circuit breaker.

7. The modified connector for a car battery of claim 1, wherein said gripping part of said main body is a C-shaped gripper matched with a screw.

8. The modified connector for a car battery of claim 1, wherein said second connection terminal of said safety device has a connection hole for the insertion of the core line of the electric wire, and a tightening screw penetrating to said connection hole is installed perpendicularly to said connection hole.

9. The modified connector for a car battery of claim 4, wherein another end of said lagging of said safety device has a third outer thread such that an insulation end cap having an inner thread can be screwed thereon to cover said second connection terminal.

* * * * *